US010138589B2

(12) United States Patent
Lee et al.

(10) Patent No.: US 10,138,589 B2
(45) Date of Patent: Nov. 27, 2018

(54) APPARATUS FOR TREATING LAUNDRY AND CONTROL METHOD THEREOF

(71) Applicant: LG ELECTRONICS INC., Seoul (KR)

(72) Inventors: Hoosun Lee, Seoul (KR); Doohyun Kim, Seoul (KR); Geunhyung Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/435,832

(22) Filed: Feb. 17, 2017

(65) Prior Publication Data

US 2017/0233941 A1 Aug. 17, 2017

(30) Foreign Application Priority Data

Feb. 17, 2016 (KR) ..... 10-2016-0018492

(51) Int. Cl.
*D06F 58/24* (2006.01)

(52) U.S. Cl.
CPC ..... *D06F 58/24* (2013.01)

(58) Field of Classification Search
CPC ..... D06F 58/24; D06F 58/02; D06F 39/028; D06F 39/085; D06F 25/00; D06F 39/005; D06F 39/088
USPC ..... 34/471, 595–610; 68/5 R, 19
See application file for complete search history.

(56) References Cited

U.S. PATENT DOCUMENTS 2,627,669 A * 2/1953 Candor ..... D06F 58/206 34/547
2,742,708 A * 4/1956 McCormick ..... D06F 58/02 34/60
2,785,557 A * 3/1957 Stilwell William E, Jr. ..... D06F 25/00 137/218
3,805,404 A * 4/1974 Gould ..... D06F 58/04 34/596
4,154,003 A * 5/1979 Muller ..... D06F 58/24 34/469
6,282,928 B1 * 9/2001 Fukumoto ..... D06F 25/00 68/20

(Continued)

FOREIGN PATENT DOCUMENTS

DE 102017103306 A1 * 8/2017 ..... D06F 58/24
EP 2949804 A1 * 12/2015 ..... D06F 58/203

(Continued)

*Primary Examiner* — Stephen M Gravini
(74) *Attorney, Agent, or Firm* — Fish & Richardson P.C.

(57) ABSTRACT

A laundry treatment apparatus that includes: a cabinet; an outer tub that is disposed inside the cabinet; a plurality of heat exchange tubes through which air discharged from the outer tub moves, the plurality of heat exchange tubes being arranged to have a gap between adjacent heat exchange tubes; a heat exchange tube housing that is configured to accommodate the plurality of heat exchange tubes and that defines an interior area configured to store cooling water; a cooling water introduction passage that is coupled to a lower portion of the heat exchange tube housing and through which cooling water is provided to the heat exchange tube housing; and a cooling water discharge passage that is coupled to a upper portion of the heat exchange tube housing and through which cooling water stored in the heat exchange tube housing is discharged is disclosed.

20 Claims, 15 Drawing Sheets

(56) References Cited

U.S. PATENT DOCUMENTS 7,121,018 B2 * 10/2006 Lee ..... D06F 58/24 34/595
7,188,437 B2 * 3/2007 Lee ..... D06F 25/00 34/595
7,526,879 B2 * 5/2009 Bae ..... D06F 58/206 34/239
7,908,766 B2 * 3/2011 Ahn ..... D06F 58/206 126/21 A
8,209,881 B2 * 7/2012 Lee ..... D06F 58/24 165/10
8,468,718 B2 * 6/2013 Favret ..... D06F 58/28 134/34
8,695,228 B2 * 4/2014 Lee ..... D06F 73/02 34/595
9,163,352 B2 * 10/2015 Han ..... D06F 58/26
9,534,329 B2 * 1/2017 Contarini ..... D06F 39/02
9,617,674 B2 * 4/2017 Hong ..... D06F 58/20
9,670,613 B2 * 6/2017 Ko ..... D06F 58/203
9,683,325 B2 * 6/2017 Kim ..... D06F 58/206
9,708,748 B2 * 7/2017 Seo ..... D06F 39/083
9,797,080 B2 * 10/2017 Doh ..... D06F 35/005
9,845,567 B2 * 12/2017 Contarini ..... D06F 58/24
2012/0131811 A1 * 5/2012 Del Pos ..... D06F 58/18 34/73
2016/0083893 A1 * 3/2016 Del Pos ..... D06F 58/04 34/595
2016/0115638 A1 * 4/2016 Kim ..... D06F 58/206 34/499
2016/0153135 A1 * 6/2016 Ryoo ..... D06F 58/206 34/108
2017/0002506 A1 * 1/2017 Contarini ..... D06F 58/24
2017/0233941 A1 * 8/2017 Lee ..... D06F 58/24 34/471
2017/0254009 A1 * 9/2017 Balinski ..... D06F 25/00

FOREIGN PATENT DOCUMENTS

EP 2949804 A4 * 7/2016 ..... D06F 58/203
KR 20140095741 A * 8/2014 ..... D06F 58/203
WO WO 2014115976 A1 * 7/2014 ..... D06F 58/203

* cited by examiner

【Fig. 1】
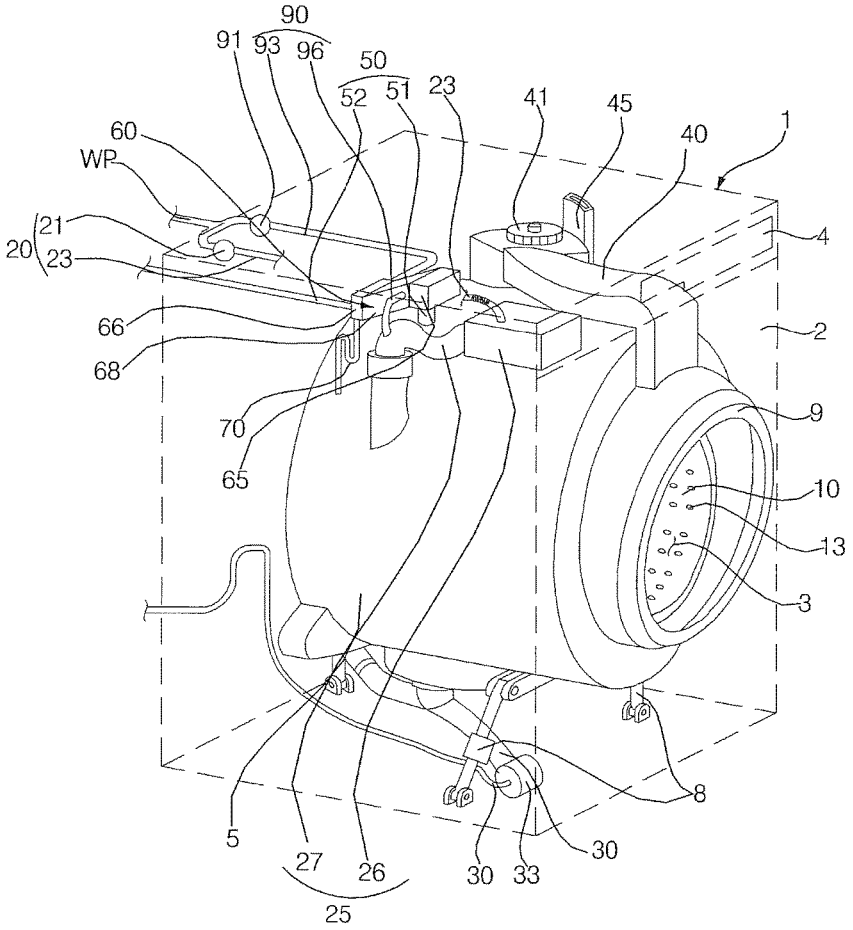

【Fig. 2】
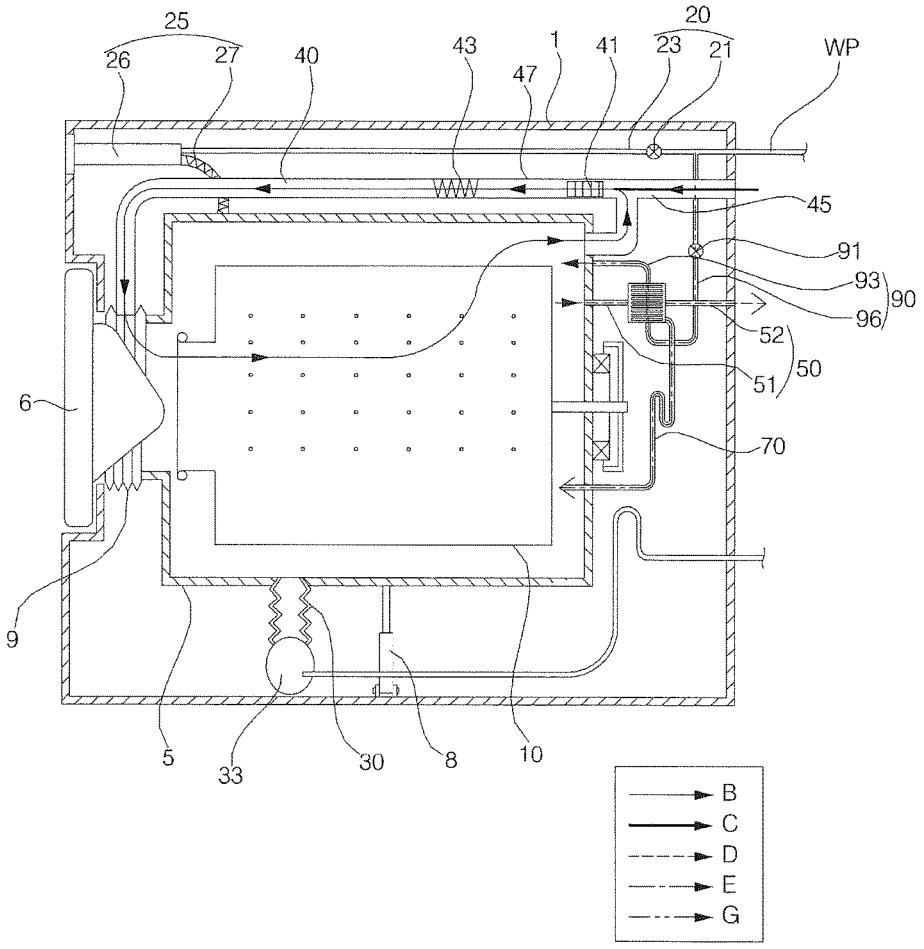

【Fig. 3】
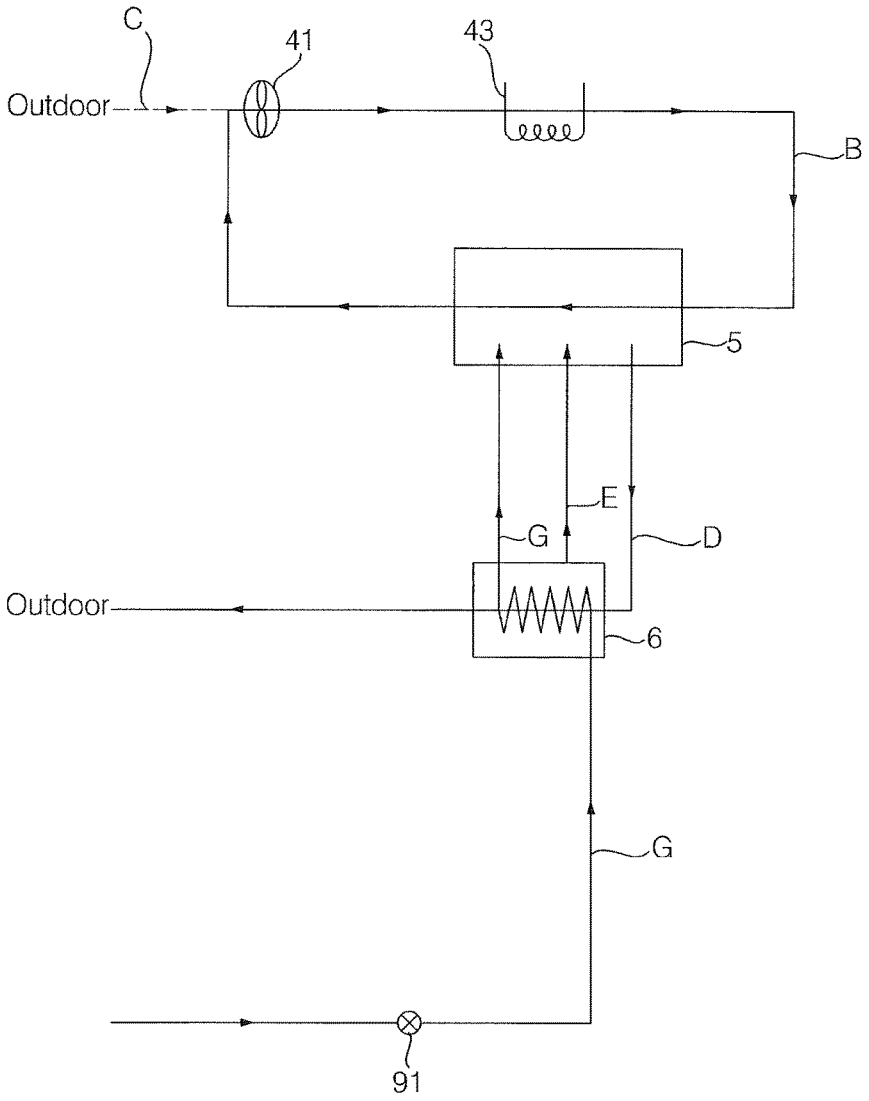

【Fig. 4】
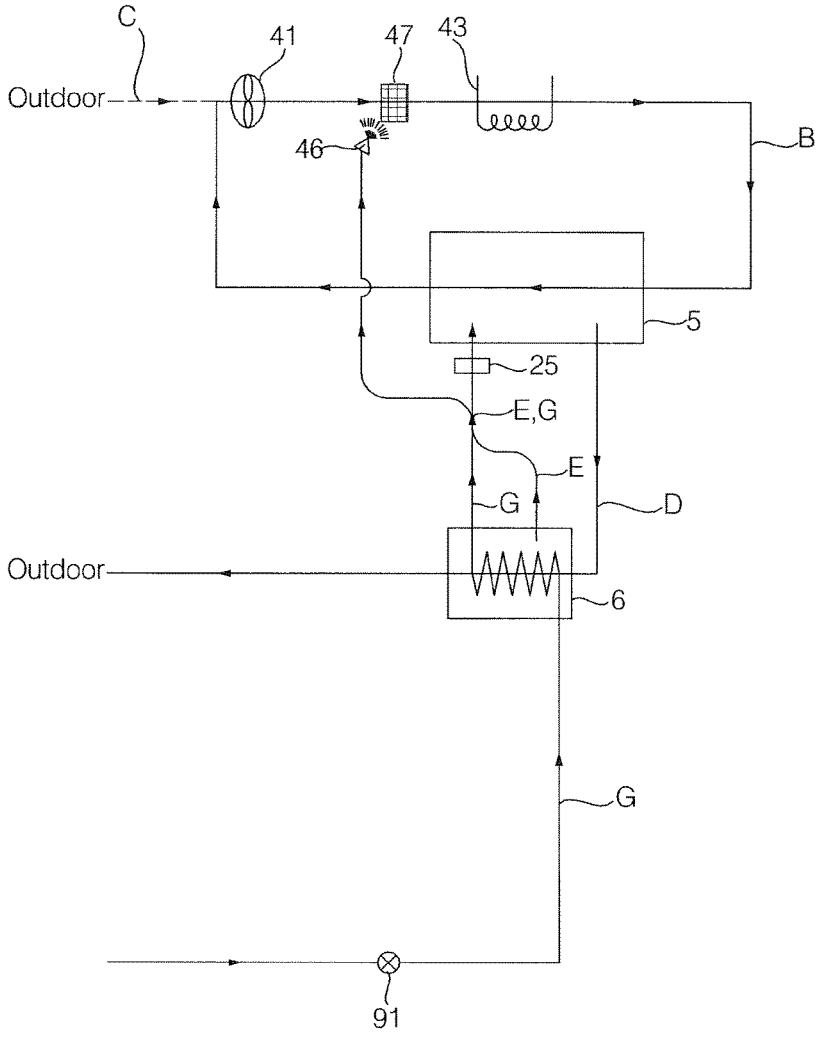

【Fig. 5】
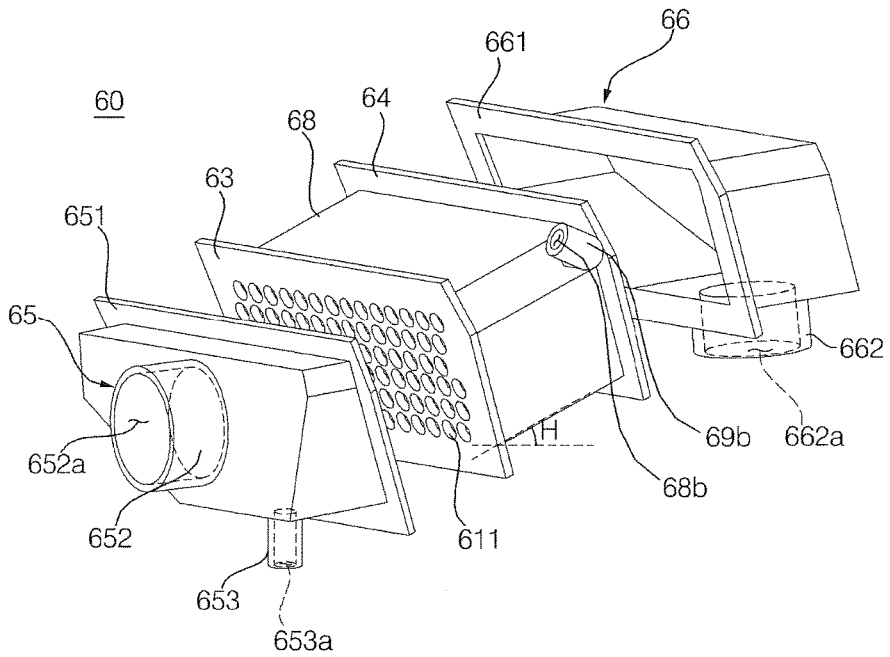

【Fig. 6】
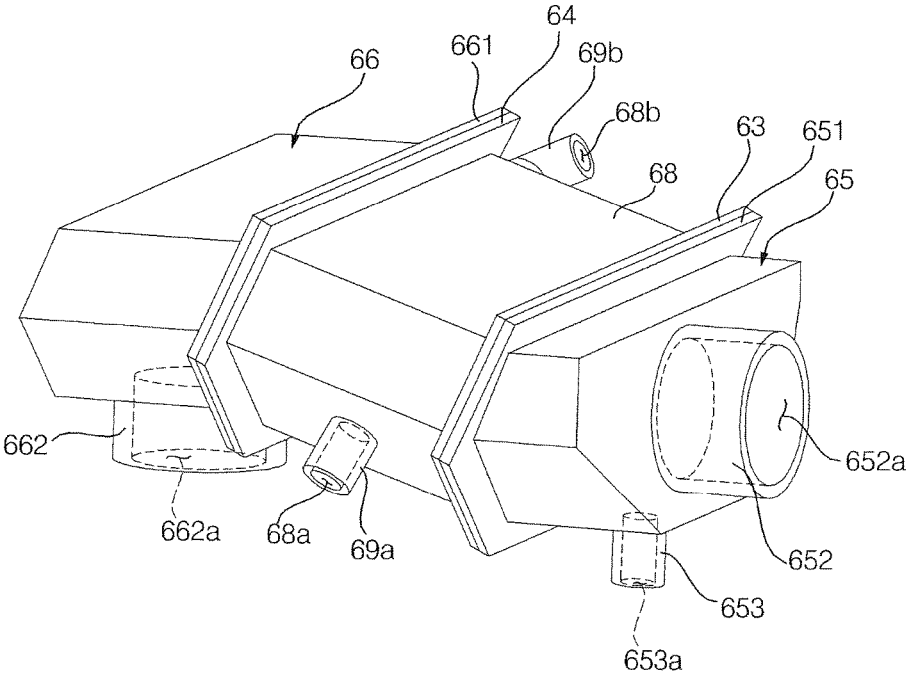

【Fig. 7】
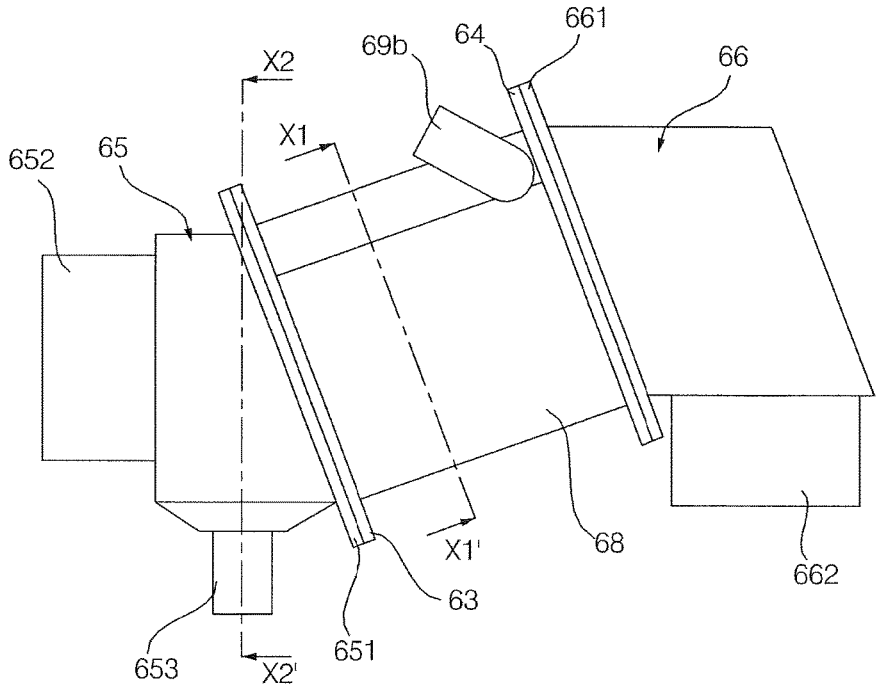

【Fig. 8】
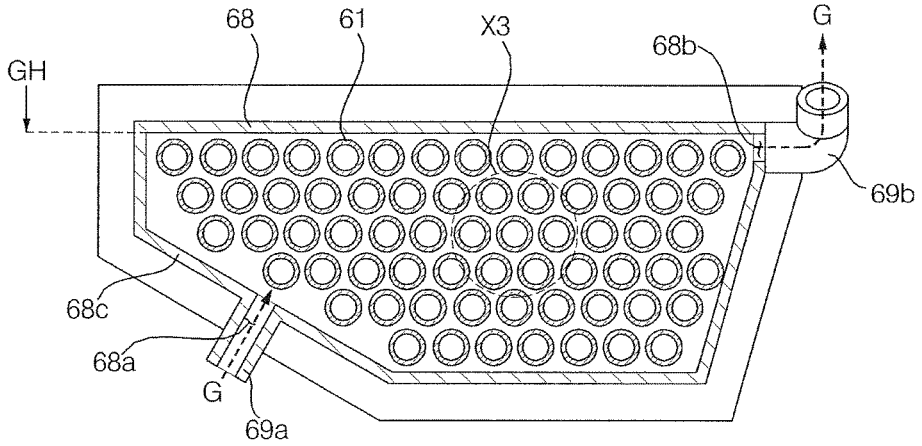

【Fig. 9】
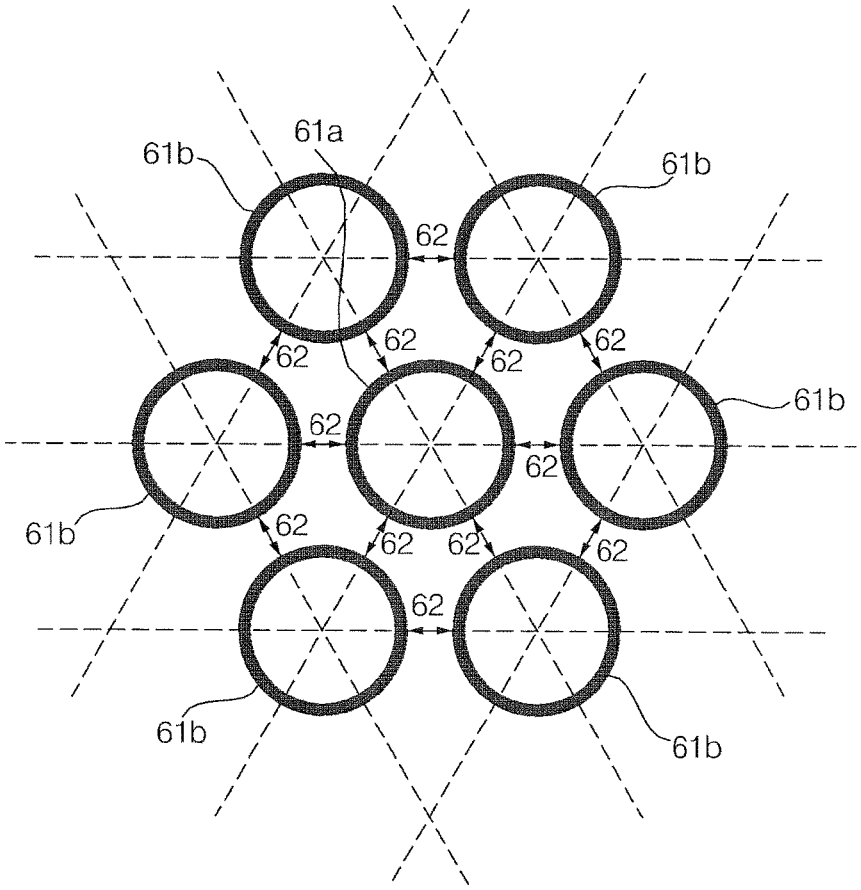

【Fig. 10】
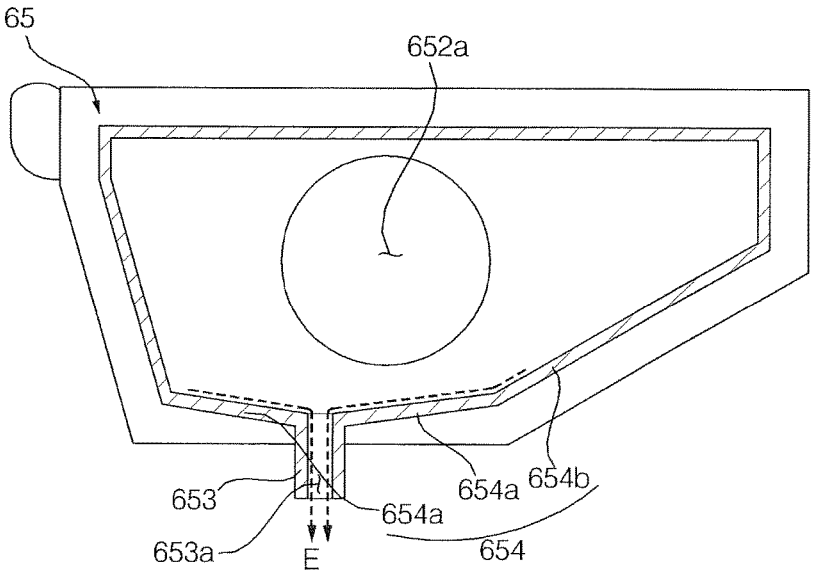

【Fig. 11】
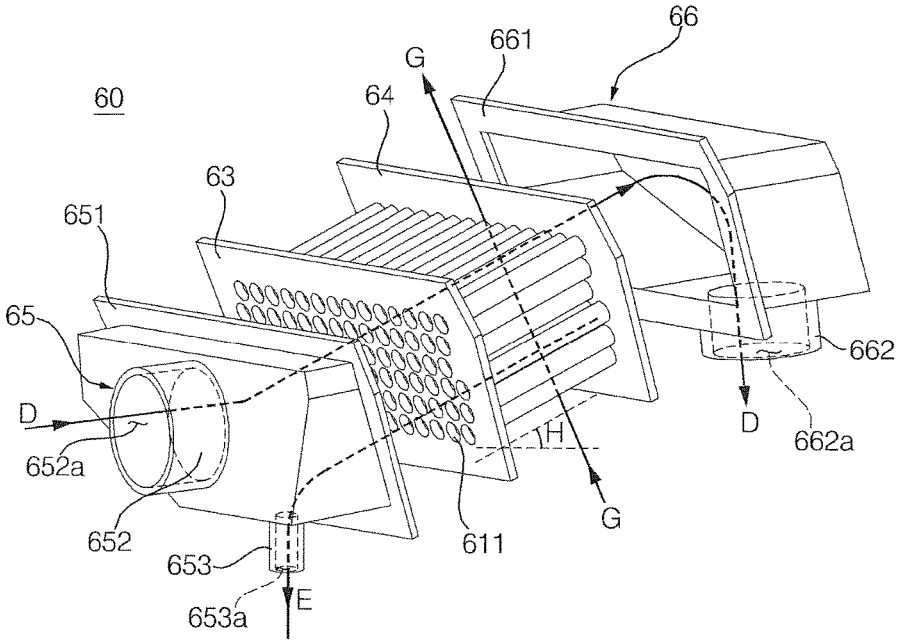

【Fig. 12】
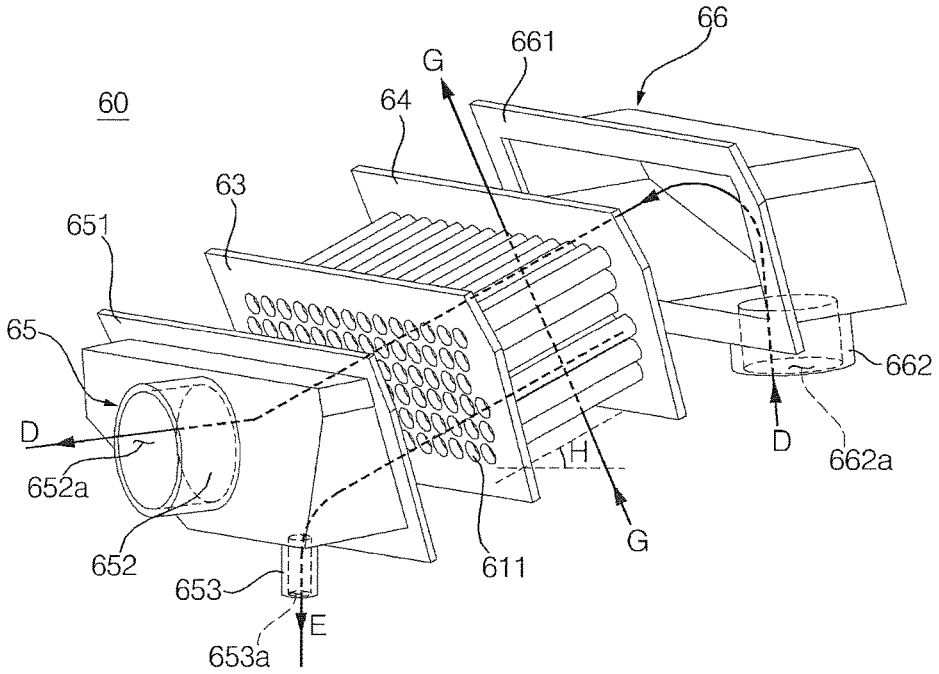

【Fig. 13】
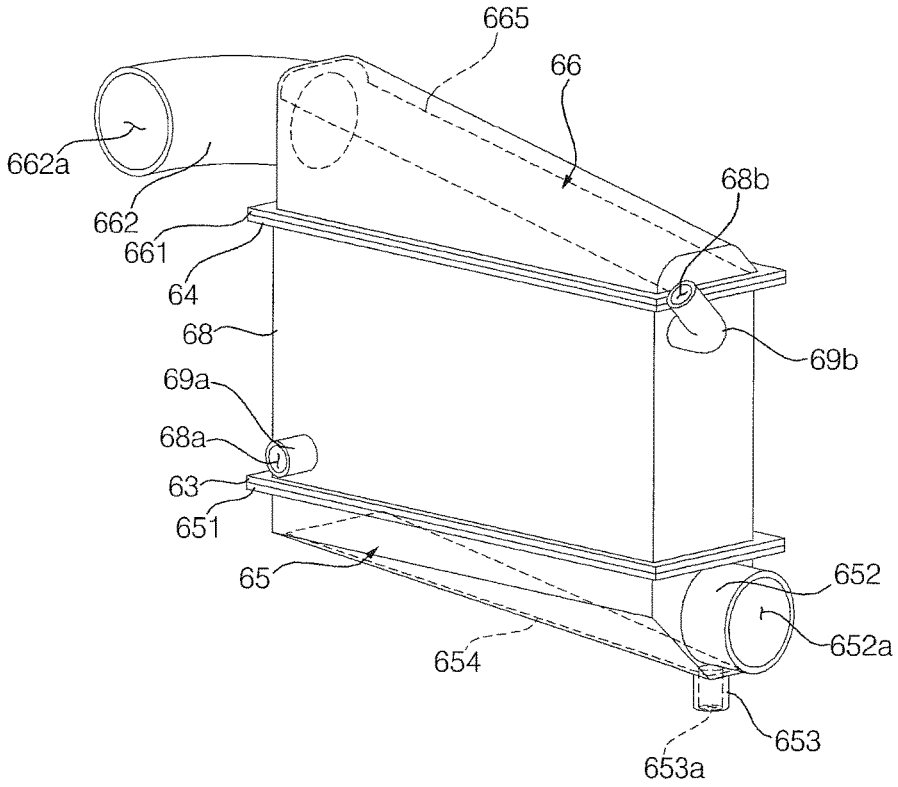

【Fig. 14】
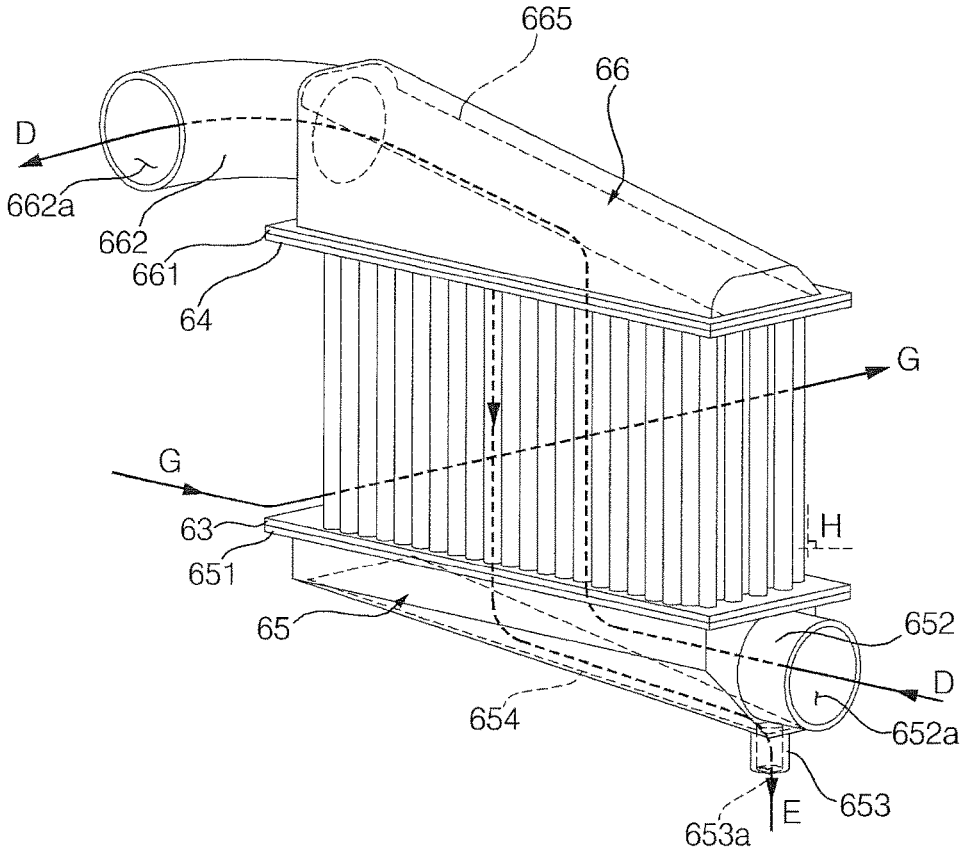

【Fig. 15】
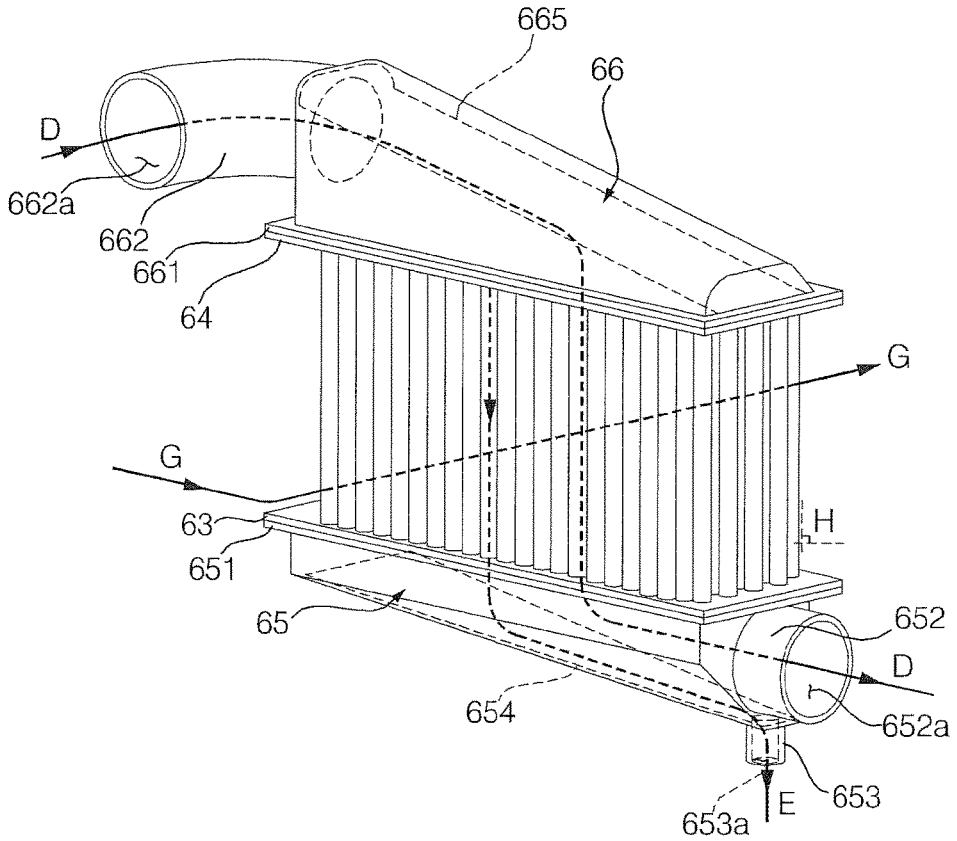

APPARATUS FOR TREATING LAUNDRY AND CONTROL METHOD THEREOF

CROSS-REFERENCE TO RELATED APPLICATION

This application claims the priority benefit of Korean Patent Application No. 10-2016-0018492, filed on Feb. 17, 2016 in the Korean Intellectual Property Office, the entire content of which is hereby incorporated by reference.

TECHNICAL FIELD

The present application generally relates to technologies related to a laundry treatment apparatus.

BACKGROUND

A laundry treatment apparatus, which enables the drying of laundry, is configured to supply heated air, e.g., hot wind, to laundry. The laundry treatment apparatus is classified, based on the method of treating the air that has completely undergone heat exchange with the laundry, into a laundry treatment apparatus having an exhaust-type drying system, a laundry treatment apparatus having a circulation-type drying system, and a laundry treatment apparatus having a hybrid system.

SUMMARY

In general, one innovative aspect of the subject matter described in this specification can be embodied in a laundry treatment apparatus comprising: a cabinet; an outer tub that is disposed inside the cabinet; a plurality of heat exchange tubes through which air discharged from the outer tub moves, the plurality of heat exchange tubes being arranged to have a gap between adjacent heat exchange tubes; a heat exchange tube housing that is configured to accommodate the plurality of heat exchange tubes and that defines an interior area configured to store cooling water; a cooling water introduction passage that is coupled to a lower portion of the heat exchange tube housing and through which cooling water is provided to the heat exchange tube housing; and a cooling water discharge passage that is coupled to a upper portion of the heat exchange tube housing and through which cooling water stored in the heat exchange tube housing is discharged.

The foregoing and other embodiments can each optionally include one or more of the following features, alone or in combination. In particular, one embodiment includes all the following features in combination. The plurality of heat exchange tubes are inclined along an air flow path of air discharged from the outer tub. The laundry treatment apparatus further includes a lower coupling unit that is coupled to a lower end of each heat exchange tube of the plurality of heat exchange tubes; and a upper coupling unit that is coupled to a upper end of each heat exchange tube of the plurality of heat exchange tubes. The laundry treatment apparatus further includes a condensed water passage that is coupled to the lower coupling unit and that is configured to guide condensed water generated in the plurality of heat exchange tubes. The laundry treatment apparatus further includes: an exhaust passage through which air is exhausted from the outer tub, wherein the plurality of heat exchange tubes are disposed in the exhaust passage. The laundry treatment apparatus further includes: a cooling water valve that is coupled to the cooling water introduction passage and that is configured to control flow of cooling water into the heat exchange tube housing. The laundry treatment apparatus further includes: a lower fastening portion that is coupled to the lower ends of the plurality of heat exchange tubes and that is configured to maintain the gap between the adjacent heat exchange tubes of the plurality of heat exchange tubes; and a upper fastening portion that is coupled to the upper ends of the plurality of heat exchange tubes and that is configured to maintain the gap between the adjacent heat exchange tubes of the plurality of heat exchange tubes. The heat exchange tube housing includes: a cooling water discharge passage coupling portion that couples the heat exchange tube housing to the cooling water discharge passage, and wherein the cooling water discharge passage coupling portion protrudes horizontally relative to the heat exchange tube housing and is bent upward. The heat exchange tube housing includes: a cooling water discharge passage coupling portion that couples the heat exchange tube housing to the cooling water discharge passage, and wherein the cooling water discharge passage coupling portion protrudes vertically relative to the heat exchange tube housing. The cooling water discharge passage couples the heat exchange tube housing to the lower coupling unit and that is configured to guide cooling water from the heat exchange tube housing to the lower coupling unit. The lower coupling unit includes: a condensed water outlet that is located at a lower portion of the lower coupling unit and that is coupled to the condensed water passage, and wherein the lower coupling unit is inclined relative to the condensed water outlet. The plurality of heat exchange tubes are inclined downwardly along the air flow path of air discharged from the outer tub. The plurality of heat exchange tubes are vertically inclined. The plurality of heat exchange tubes are inclined upwardly along the air flow path of air discharged from the outer tub. The plurality of heat exchange tubes are vertically inclined.

In general, another innovative aspect of the subject matter described in this specification can be embodied in a control method of a laundry treatment apparatus, the laundry treatment apparatus comprising a cabinet, an outer tub that is disposed inside the cabinet, a plurality of heat exchange tubes through which air discharged from the outer tub moves, the plurality of heat exchange tubes being arranged to have a gap between adjacent heat exchange tubes, a heat exchange tube housing that is configured to accommodate the plurality of heat exchange tubes and that defines an interior area configured to store cooling water, a cooling water introduction passage that is coupled to a lower portion of the heat exchange tube housing and through which cooling water is provided to the heat exchange tube housing, and a cooling water discharge passage that is coupled to a upper portion of the heat exchange tube housing and through which cooling water stored in the heat exchange tube housing is discharged, the control method comprising: providing the air through the plurality of heat exchange tubes; and intermittently supplying cooling water to the heat exchange tube housing during the providing the air, wherein the intermittently supplying cooling water repeats a process of blocking the cooling water so that the cooling water gathers inside the heat exchange tube housing and a process of supplying the cooling water into the heat exchange tube housing.

The foregoing and other embodiments can each optionally include one or more of the following features, alone or in combination. In particular, one embodiment includes all the following features in combination. The control method further includes: before the intermittently supplying cooling water, filling the heat exchange tube housing with cooling water until at least a lower portion of each heat exchange tube of the plurality of heat exchange tubes is submerged in cooling water. The control method further includes: sensing a temperature of cooling water in the heat exchange tube housing, and based on the temperature of cooling water in the heat exchange tube housing, controlling a first time duration of the process of blocking the cooling water and a second time duration of the process of supplying the cooling water into the heat exchange tube housing. The control method further includes: sensing a temperature of cooling water in the heat exchange tube housing, and based on the temperature of cooling water in the heat exchange tube housing, controlling timing to begin blocking the cooling water discharge passage. The control method further includes: sensing a temperature of cooling water in the heat exchange tube housing, and based on the temperature of cooling water in the heat exchange tube housing, controlling timing to begin supplying cooling water to the heat exchange tube housing.

The subject matter described in this specification can be implemented in particular examples so as to realize one or more of the following advantages. Comparing to a conventional laundry treatment apparatus, a laundry treatment apparatus includes multiple heat exchange tubes, which increases the time that moisture in air is condensed prior to being exhausted to the outside. In addition, the contact surface area over which the moisture is condensed is increased. As a result, dew condensation around the laundry treatment apparatus can be reduced.

Furthermore, the dehumidification performance and the heat exchange performance of a condensation device may further be increased.

Moreover, the laundry treatment apparatus has particular arrangements of the heat exchange tubes, which enables the condensation device to be easily manufactured as a modular structure.

In addition, the heat exchange tubes can be made of various materials and have various diameters and gaps between the heat exchange tubes. Thus, the condensation device can be free from corrosion and be light-weight. Also, condensed water generated in the condensation device can be easily gathered.

The details of one or more examples are set forth in the accompanying drawings and the description below. Other features, objects, and advantages of the invention will be apparent from the description and drawings, and from the claims

BRIEF DESCRIPTION OF THE DRAWINGS

FIG. 1 is a diagram illustrating an example laundry treatment apparatus.

FIG. 2 is a diagram illustrating example passages and flows of air and water in an example laundry treatment apparatus.

FIG. 3 is a diagram illustrating example flows of air and water inside an example laundry treatment apparatus.

FIG. 4 is a diagram illustrating example flows of air and water inside another example laundry treatment apparatus.

FIGS. 5 to 10 are diagrams illustrating example condensation unit.

FIG. 11 is a diagram illustrating example flows of air and water in the example condensation unit of FIG. 5.

FIG. 12 is a diagram illustrating another example flows of air and water in the example condensation unit of FIG. 5.

FIG. 13 is a diagram illustrating an example condensation unit.

FIG. 14 is a diagram illustrating example flows of air and water in the example condensation unit of FIG. 13.

FIG. 15 is a diagram illustrating another example flow of air and water in the example condensation unit of FIG. 13.

Like reference numbers and designations in the various drawings indicate like elements.

DETAILED DESCRIPTION

FIG. 1 illustrates an example laundry treatment apparatus. FIG. 2 illustrates example passages and flows of air and water in an example laundry treatment apparatus. Examples of the laundry treatment apparatus can be a washing machine, a drying machine, or a machine including a washing machine or a drying machine. As illustrated, the laundry treatment apparatus can be a front-loading-type washing machine having a drying system. Any suitable drying system can be used for the laundry treatment apparatus. In some implementations, the laundry treatment apparatus can include a hybrid drying system that circulates a portion of the air inside an outer tub and exhausts the remaining air. In some other implementations, the laundry treatment apparatus can include an exhaust-type drying system. In this example, a condensation unit 60 may be provided in the flow path of air that is exhausted from an exhaust-type drying system, or may be provided in the flow path of air that is circulated in a circulation-type drying system.

Referring to FIGS. 1 and 2, the washing machine includes a cabinet 1 defining the external appearance thereof. The washing machine includes an outer tub 5, which is placed inside the cabinet 1 and stores wash water therein, and an inner tub 10, which is rotatably provided inside the outer tub 5 and accommodates the wash water and laundry therein. The outer tub 5 accommodates air containing moisture, which is generated from the laundry inside the inner tub 10.

In addition, the washing machine includes a water supply pipe WP, which guides the wash water from an external water supply source to the inside of the cabinet 1. The washing machine includes a water supply unit 20, which supplies the water, introduced through the water supply pipe WP, to the inside of the outer tub 5, and a detergent supply unit 25, which supplies detergent to the outer tub 5. In addition, the washing machine includes a water-drain passage 30, which guides the wash water inside the outer tub 5 so as to be drained to the outside of the cabinet 1, and a water-drain pump 33, which is provided in the water-drain passage 30 and is operated to drain the wash water.

In addition, the washing machine includes a circulation passage 40, which guides a portion of the air inside the outer tub 5 so as to be discharged from the outer tub 5 and then to be re-supplied to the outer tub 5. The washing machine includes a circulation fan 41, which is provided in the circulation passage 40 to circulate the air inside the outer tub 5 along the circulation passage 40, and a heater 43, which is provided in the circulation passage 40 to heat the air to be introduced into the outer tub 5.

In addition, the washing machine includes an air suction passage 45, which guides the air outside the outer tub 5 or the cabinet 1 so as to be introduced into the outer tub 5, and an exhaust passage 50, which guides the air inside the outer tub 5 so as to be exhausted. In this example, the exhaust passage 50 guides the exhaust of a portion of the air inside the outer tub 5, excluding some air, which is to be introduced into the circulation passage 40. The air suction passage 45 or the circulation passage 40 may be provided with a filter 47 to filter the introduced outside air.

The cabinet 1 includes a front panel 2, which forms the front surface of the laundry treatment apparatus. The front panel 2 is provided with an opening 3, through which laundry is put into or taken out from the inner tub 10. The opening 3 is opened or closed by a door 6, which is rotatably coupled to the cabinet 1.

The front panel 2 may be provided with a control panel 4, which is a user interface. The control panel 4 serves to enable information exchange between a user and a controller of the washing machine.

The control panel 4 includes a power input unit, which allows the user to input a power supply command to the washing machine, and an input unit, which allows the user to select an available laundry treatment method. The laundry treatment method includes a method of controlling the supply of water or air to laundry. The control panel 4 may be provided with a display unit, which displays information related to the laundry treatment method selected by the user or the operating process of the washing machine.

The outer tub 5 has a cylindrical shape and is fixed inside the cabinet 1 by an outer tub support unit 8. An outer tub opening is formed in the front surface of the outer tub 5 so as to be in communication with the opening 3.

A gasket 9 is provided between the outer tub opening and the opening 3. The gasket 9 prevents vibrations generated in the outer tub 5 from being transferred to the cabinet 1, and also prevents the leakage of wash water stored in the outer tub 5. The gasket 9 may be formed of an elastic material, such as rubber.

The inner tub 10 is provided inside the outer tub 5 so as to be rotatable by a drive unit, which is provided on the rear surface of the outer tub 5. The inner tub 10 is formed with an inner tub opening, which is in communication with the outer tub opening, and an inner tub through-hole 13, which penetrates the outer circumferential surface of the inner tub 10.

The water supply unit 20 includes a water supply passage 23, which guides the water from the water supply pipe WP, which is provided outside the cabinet 1, to the detergent supply unit 25, and a water supply valve 21, which opens or closes the water supply passage 23. The detergent supply unit 25 includes a detergent reservoir 26 in which detergent is stored, and an outer tub supply pipe 27, which guides the water containing the detergent from the detergent reservoir 26 to the inside of the outer tub 5. The detergent reservoir 26 may be pulled outward from the front panel 2.

The water-drain passage 30 is provided so as to extend upward to a position that is higher than the level of the wash water inside the outer tub 5, whereby a water trap may be provided by the wash water to be drained. The water-drain pump 33 may be located lower than the level of the wash water inside the outer tub 5, and more particularly, may be located at the lowermost position of the water-drain passage 30.

The circulation passage 40 guides a portion of the air inside the outer tub 5 so as to be discharged from the outer tub 5 and to then be re-supplied to the outer tub 5. The circulation passage 40 may be provided on the upper outer circumferential surface of the outer tub 5. The beginning end and the terminating end of the circulation passage 40 are provided with communication regions, which are coupled to the outer tub 5. The communication region in the terminating end of the circulation passage 40 may be provided at the upper side of the gasket 9. That is, a hole is formed in the gasket 9 and the circulation passage 40 is coupled to the hole.

The air suction passage 45 can be coupled to the outer tub 5. In some implementations, the air suction passage 45 may be directly coupled to the outer tub 5, or may be coupled to the flow path of the circulation passage 40. The air suction passage 45 guides the outside air so as to be introduced into the circulation passage 40, and the heater 43 is provided at the downstream side of the point at which the air is introduced into the circulation passage 40 from the air suction passage 45. In addition, the circulation fan 41 is provided at the downstream side of the point at which the air is introduced into the circulation passage 40 from the air suction passage 45. In this way, both the circulating air and the suctioned air may be heated by one heater 43, and both the circulation and suction of air may be performed by one circulation fan 41.

In some implementations, where an air suction port of the air suction passage 45 is present inside the cabinet 1, the air in the space between the cabinet 1 and the outer tub 5 is introduced into the outer tub 5. In the case where the air suction port of the air suction passage 45 is present outside the cabinet 1, the air outside the cabinet 1 is introduced into the outer tub 5. In this description, the meaning of "outside air" includes both the air outside the cabinet 1 and the air between the cabinet 1 and the outer tub 5.

In this example, the filter 47 is disposed in the circulation passage 40 to filter foreign substances contained in the moving air. The filter 47 is provided at the downstream side of the connection point of the circulation passage 40 and the air suction passage 45. The washing machine includes a filter washing nozzle 48, which ejects water so as to remove the foreign substances filtered by the filter 47.

The washing machine includes a condensation unit 60, which is disposed in the flow path of the air discharged from the outer tub 5, and a condensed water passage 70, which guides condensed water generated in the condensation unit 60. In this example, although the flow path of air is described as the exhaust passage 50, the flow path of air may be the circulation passage 40.

The washing machine may include a cold air passage, which guides the outside air, which undergoes heat exchange with the air discharged from the outer tub 5 in the condensation unit 60, and may further include a cooling water passage 90, which guides water, which undergoes heat exchange with the air discharged from the outer tub 5 in the condensation unit 60.

The condensation unit 60 includes a plurality of heat exchange tubes 61, which is disposed in the flow path of air discharged from the outer tub 5 and forms predetermined gaps 62 therebetween. The heat exchange tubes 61 are oriented so as to be inclined. The angle between the inclined heat exchange tubes 61 and the ground surface is defined as an inclination angle H.

The heat exchange tubes 61 may be disposed in the exhaust passage 50. As such, the time during which the moisture in the air may be condensed prior to being exhausted to the outside may be increased, and the contact surface area over which the moisture may be condensed may be increased, which may suppress dew condensation around the washing machine.

The heat exchange tubes 61 have a structure in which circular slender tubes form a bundle and are arranged parallel to each other. The air to be exhausted and the condensed water move through the inside of the heat exchange tubes 61. Cold air or cooling water, which is a heat exchange medium, moves through the predetermined gaps 62 between the heat exchange tubes 61, which are spaced apart from each other.

An exhaust introduction passage 51 guides a portion of the air inside the outer tub 5, excluding the circulating air, so as to be introduced into the heat exchange tubes 61. In this example, one end of the exhaust introduction passage 51 is coupled to, e.g., directly connected to, the outer tub 5. In some implementations, the exhaust introduction passage 51 can be coupled to the upper outer circumferential surface of the outer tub 5.

An exhaust discharge passage 52 guides the air, discharged from the heat exchange tubes 61, so as to be discharged to the outside. In some implementations, the exhaust discharge passage 52 discharges air to the outside of the cabinet 1. In some other implementations, the exhaust discharge passage 52 may discharge air to the space between the outer tub 5 and the cabinet 1.

The condensation unit 60 includes a lower coupling unit 65, which combines a plurality of flow paths defined in the heat exchange tubes 61 at the lower end of both longitudinal ends of the heat exchange tubes 61, and an upper coupling unit 66, which combines the flow paths defined in the heat exchange tubes 61 at the upper end of both longitudinal ends of the heat exchange tubes 61.

Any one of the lower coupling unit 65 and the upper coupling unit 66 is coupled to the exhaust introduction passage 51, and the other one is coupled to the exhaust discharge passage 52. The exhaust introduction passage 51, the exhaust discharge passage 52, the flow paths defined in the respective heat exchange tubes 61, the lower coupling unit 65, and the upper coupling unit 66 form an air flow path, which guides the flow of air in a given direction.

Referring to FIGS. 11 to 14, in some implementations, the lower coupling unit 65 interconnects the lower end of the heat exchange tubes 61 and the exhaust introduction passage 51, and guides the air discharged from the exhaust introduction passage 51 so as to be wholly introduced into the heat exchange tubes 61. The upper coupling unit 66 interconnects the upper end of the heat exchange tubes 61 and the exhaust discharge passage 52, and guides the air discharged from the heat exchange tubes 61 so as to be wholly introduced into the exhaust discharge passage 52.

Referring to FIGS. 12 and 15, in some implementations, the upper coupling unit 66 interconnects the upper end of the heat exchange tubes 61 and the exhaust introduction passage 51, and guides the air discharged from the exhaust introduction passage 51 so as to be wholly introduced into the heat exchange tubes 61. The lower coupling unit 65 interconnects the lower end of the heat exchange tubes 61 and the exhaust discharge passage 52, and guides the air discharged from the heat exchange tubes 61 so as to be wholly introduced into the exhaust discharge passage 52.

The condensed water passage 70 guides the condensed water generated in the heat exchange tubes 61. The condensed water passage 70 is coupled to the lower coupling unit 65. One end of the condensed water passage 70 is coupled to the lower coupling unit 65, which is coupled to the side of the inclined heat exchange tubes 61, from which the condensed water moves. The other end of the condensed water passage 70 may be coupled to the water-drain passage 30 in order to drain the condensed water to the outside of the cabinet 1, or may be coupled to the outer tub 5 in order to direct the condensed water to the inside of the outer tub 5, as illustrated in FIGS. 1 and 2. The condensed water passage 70 has a zone in which a water trap is formed. The water trap prevents the air moving through the exhaust passage 50 from moving through the condensed water passage 70, and also prevents the air inside the outer tub 5 from moving through the condensed water passage 70.

The condensation unit 60 may include a heat exchange tube housing 68, which accommodates the heat exchange tubes 61 and defines a space in which the heat exchange medium (cold air or cooling water) is accommodated. The heat exchange tube housing 68 is formed so as to surround all of the heat exchange tubes 61. In this case, the heat exchange tube housing 68 is coupled to the cold air passage or the cooling water passage 90, and guides the air (cold air) or the water (cooling water) to the predetermined gaps 62 between the heat exchange tubes 61. In some implementations, the condensation unit 60 may include no heat exchange tube housing 68. In this case, the cold air or the cooling water may also move to the predetermined gaps 62.

In some implementations, the laundry treatment apparatus includes the cooling water passage 90. In some other implementations, the laundry treatment apparatus does not include the cooling water passage 90.

The cooling water passage 90 may guide the cooling water so as to pass through the predetermined gaps 62. The cooling water passage 90 may be formed by, for example, a separate pipe.

The cooling water passage 90 includes a cooling water introduction passage 93, which guides the cooling water so as to be introduced into the heat exchange tube housing 68. The cooling water introduction passage 93 is coupled to the lower portion of the heat exchange tube housing 68.

The cooling water passage 90 includes a cooling water discharge passage 96, which guides the cooling water so as to be discharged from the inside of the heat exchange tube housing 68. The cooling water discharge passage 96 is coupled to the upper portion of the heat exchange tube housing 68.

When the cooling water introduction passage 93 and the cooling water discharge passage 96 are respectively coupled to the lower portion and the upper portion of the heat exchange tube housing 68, the cooling water having a higher temperature moves upward due to convection inside the heat exchange tube housing 68 so as to be first discharged through the cooling water discharge passage 96, which may increase heat exchange efficiency.

The washing machine may be provided with a cooling water valve 91, which is provided in the cooling water introduction passage 93 and is opened or closed to selectively permit the introduction of cooling water to the heat exchange tube housing 68. When the cooling water valve 91 is opened, the cooling water is introduced into the heat exchange tube housing 68. When the cooling water valve 91 is closed, no cooling water is introduced into the heat exchange tube housing 68.

The cooling water valve 91 may cause the cooling water to gather inside the heat exchange tube housing 68. When the cooling water valve 91 is closed, the cooling water gathers inside the heat exchange tube housing 68. Thereby, the cooling water, the temperature of which is not sufficiently raised, may gather inside the heat exchange tube housing 68 and undergo heat exchange with the air to be exhausted.

As illustrated in FIGS. 1 and 2, the cooling water introduction passage 93 may be coupled to the water supply pipe WP so that the cooling water is moved by the pressure of the water from the water supply source. In some implementations, the washing machine may include a cooling water pump, which is coupled to the cooling water introduction passage 93 and pumps the cooling water into the heat exchange tube housing 68. Through this pumping, the movement of the cooling water may be realized.

The cooling water may be water that is directly supplied from the water supply source, may be the condensed water generated in the heat exchange tubes 61, or may be the wash water used in the water tub 5.

FIG. 3 illustrates example flows of air and water inside an example laundry treatment apparatus.

Referring to FIGS. 2 and 3, the direction of the arrow B is the circulation direction of air inside the outer tub 5. When the circulation fan 41 is operated, a portion of the air moves from the inside of the outer tub 5, which is in the positive pressure state, to the circulation passage 40, which is in the negative pressure state, through the beginning end of the circulation passage 40. The air that has moved to the circulation passage 40 is heated while passing through the heater 43 and is re-supplied to the inside of the outer tub 5.

The direction of the arrow C is the suction direction of outside air. When the circulation fan 41 is operated, the outside air is introduced from the outside of the outer tub 5 or the outside of the cabinet 1, which is in the atmospheric pressure state, to the circulation passage 40, which is in the negative pressure state. The air that has been introduced into the circulation passage 40 is heated while passing through the heater 43 and is supplied to the inside of the outer tub 5.

The direction of the arrow D is the exhaust direction of air. When the circulation fan 41 is operated, the air is introduced from the inside of the outer tub 5, which is in the positive pressure state, into the heat exchange tubes 61 through the exhaust introduction passage 51. The air that has been introduced into the heat exchange tubes 61 undergoes heat exchange with the heat exchange medium, which moves through the predetermined gaps 62 and generates condensed water. The air, from which the condensed water has been generated, is introduced into the exhaust discharge passage 52 and is exhausted to the outside of the outer tub 5 or the outside of the cabinet 1.

The direction of the arrow E is the flow direction of condensed water. The condensed water generated in the heat exchange tubes 61 moves down along the inner surfaces of the heat exchange tubes 61 and gathers in the lower coupling unit 65. The gathered condensed water is introduced into the condensed water passage 70. The condensed water that has been introduced into the condensed water passage 70 moves to the inside of the outer tub 5. The condensed water that has been moved to the inside of the outer tub 5 may be drained to the outside of the cabinet 1 through the water-drain passage 30.

The direction of the arrow G is the flow direction of cooling water. When the cooling water valve 91 is opened, the cooling water is introduced from the water supply pipe WP to the inside of the heat exchange tube housing 68 through the cooling water introduction passage 93. The cooling water that has been introduced into the heat exchange tube housing 68 undergoes heat exchange with the air inside the heat exchange tubes 61. When the cooling water inside the heat exchange tube housing 68 has the level of water GH, which is the same height as a cooling water outlet 68*b*, the cooling water is discharged to the cooling water discharge passage 96 (see FIG. 8). The cooling water moves to the inside of the outer tub 5 through the cooling water discharge passage 96. The condensed water moved to the inside of the outer tub 5 may be drained to the outside of the cabinet 1 through the water-drain passage 30.

FIG. 4 illustrates example flows of air and water inside another example laundry treatment apparatus. Details regarding the directions of the arrows B, C and D can be the same as described with reference to FIG. 3.

The direction of the arrow E is the flow direction of condensed water. The condensed water generated in the heat exchange tubes 61 moves down along the inner surfaces of the heat exchange tubes 61 and gathers in the lower coupling unit 65. The gathered condensed water may be guided to the detergent supply unit 25 or the filter washing nozzle 48 through the condensed water passage 70. That is, the condensed water passage 70 may guide the condensed water such that at least a portion of the condensed water is introduced into the detergent supply unit 25 and at least a portion of the condensed water is supplied to the filter washing nozzle 48.

The direction of the arrow G is the flow direction of cooling water. When the cooling water valve 91 is opened, the cooling water is introduced from the water supply pipe WP to the inside of the heat exchange tube housing 68 through the cooling water introduction passage 93. The cooling water that has been introduced into the heat exchange tube housing 68 undergoes heat exchange with the air inside the heat exchange tubes 61. When the cooling water inside the heat exchange tube housing 68 has the level of water GH, which is the same height as the cooling water outlet 68*b*, the cooling water is discharged to the cooling water discharge passage 96 (see FIG. 8). The cooling water may be guided to the detergent supply unit 25 or the filter washing nozzle 48 through the cooling water discharge passage 96. That is, the cooling water discharge passage 96 may guide the cooling water such that at least a portion of the cooling water is introduced into the detergent supply unit 25 and at least a portion of the cooling water is supplied to the filter washing nozzle 48.

In the implementations described with reference to FIGS. 3 and 4, the condensed water passage 70 may be coupled to, e.g., be connected to, the cooling water discharge passage 96 so as to guide the condensed water from the lower coupling unit 65 to the cooling water discharge passage 96. In this case, the condensed water generated in the heat exchange tubes 61 is introduced into the cooling water discharge passage 96 through the condensed water passage 70, and moves to the terminating end of the cooling water discharge passage 96 by passing through the cooling water discharge passage 96.

In addition, the cooling water discharge passage 96 may be coupled, e.g., be connected to, the condensed water passage 70 so as to guide the cooling water from the inside of the heat exchange tube housing 68 to the condensed water passage 70. In this case, the cooling water that has passed through the inside of the heat exchange tube housing 68 is introduced into the condensed water passage 70 through the cooling water discharge passage 52, and moves to the trailing end of the condensed water passage 70 by passing through the condensed water passage 70.

Furthermore, the cooling water discharge passage 96 may be coupled to, e.g., connected to, the lower coupling unit 65 so as to guide the cooling water from the inside of the heat exchange tube housing 68 to the inside of the lower coupling unit 65. In this case, the cooling water that has passed through the inside of the heat exchange tube housing 68 is introduced into the lower coupling unit 65 through the cooling water discharge passage 96 and then moves to the terminating end of the condensed water passage 70 by passing through the condensed water passage 70. For example, the cooling water discharge passage 96 may be coupled to a condensed water passage connection portion 653 so as to guide the cooling water from the inside of the heat exchange tube housing 68 to the condensed water passage connection portion 653, which will be described later.

In some implementations, the condensed water may be introduced into the cooling water introduction passage 93 so as to undergo heat exchange with the air to be exhausted. To this end, the condensed water passage 70 is coupled to the cooling water introduction passage 93. In this way, the condensed water generated in the heat exchange tubes 61 is introduced into the cooling water introduction passage 93 through the condensed water passage 70, moves to the predetermined gaps 62 through the cooling water introduction passage 93, and thereafter moves through the cooling water discharge passage 96.

FIGS. 5 to 10 illustrate an example condensation unit. FIG. 11 illustrates example flows of air and water in the example condensation unit of FIG. 5. FIG. 12 illustrates another example flows of air and water in the example condensation unit of FIG. 5.

The inclination angle H of the heat exchange tubes 61 is an acute angle. The longitudinal direction of the heat exchange tubes 61 refers to the direction in which the heat exchange tubes 61 extend.

The washing machine includes fastening portions 63 and 64, which are respectively provided at both longitudinal ends of the heat exchange tubes 61 to fix the heat exchange tubes such that the heat exchange tubes 61 maintain the predetermined gaps 62 therebetween. A lower fastening portion 63 is provided at the lower end of both the longitudinal ends of the heat exchange tubes 61 to fix the heat exchange tubes such that the heat exchange tubes 61 maintain the predetermined gaps 62 therebetween. An upper fastening portion 64 is provided at the upper end of both the longitudinal ends of the heat exchange tubes 61 to fix the heat exchange tubes such that the heat exchange tubes 61 maintain the predetermined gaps 62 therebetween. In this way, the heat exchange tubes 61 may be easily manufactured or formed to a single unit.

The lower fastening portion 63 and the upper fastening portion 64 may take the form of a plate, which is oriented perpendicular to the longitudinal direction of the heat exchange tubes 61. The lower fastening portion 63 may be formed with lower holes 611 in the heat exchange tubes 61, and the upper fastening portion 64 may be formed with upper holes in the heat exchange tubes 61. The presence of the lower hole 611 and the upper hole means that both ends of the flow path penetrate the heat exchange tube 61.

The heat exchange tubes 61 may be formed of a synthetic resin. The manufacture of the heat exchange tubes 61 using a synthetic resin ensures easy manufacture and reduced manufacturing costs so long as the heat exchange tubes 61 are not deformed by the temperature of the air to be exhausted.

The lower fastening portion 63 and the upper fastening portion 64 may be integrally formed with the heat exchange tubes 61 via injection molding, or may be prepared as separate parts and then assembled with the heat exchange tubes 61.

Each of the heat exchange tubes 61 may have a diameter within a range from 5 mm to 7 mm. A tube having a smaller diameter may be advantageous so long as it is ensured that the tube 61 is not clogged by the condensed water, but smoothly moves through the tube 61. A diameter of the tube within a range from 5 mm to 7 mm may ensure efficient heat exchange between the heat exchange medium (cold air or cooling water) and the air to be exhausted and the smooth movement of the condensed water in the tube 61. The heat exchange tubes 61 may be provided such that the predetermined gap 62 therebetween is smaller than the radius of the tube 61.

Referring to FIGS. 8 and 9, the heat exchange tubes 61 are arranged such that six heat exchange tubes 61*b*, which are spaced apart from any one heat exchange tube 61*a* by the predetermined gaps 62, define the same predetermined gap 62 therebetween and surround the heat exchange tube 61*a*. The arrangement of the heat exchange tubes 61 facilitates the easy manufacture of the heat exchange tubes 61 having a modular configuration. That is, in a transverse cross section, the heat exchange tubes 61*b* may radially extend in six directions about any one heat exchange tube 61*a*. The six directions define an angle of 60 degrees therebetween. With this arrangement, the heat exchange tubes 61 may be easily mounted to the washing machine, and thus may be easily designed and manufactured.

The heat exchange tube housing 68 is located between the lower fastening portion 63 and the upper fastening portion 64 so as to surround the heat exchange tubes 61. Both ends of the heat exchange tube housing 68 are coupled respectively to the lower fastening portion 63 and the upper fastening portion 64. That is, the space in which the cooling water may gather is defined by the heat exchange tube housing 68, the lower fastening portion 63, and the upper fastening portion 64.

The heat exchange tube housing 68 includes a cooling water introduction passage connection portion 69*a*, which connects the inside of the heat exchange tube housing 68 to the cooling water introduction passage 93. The cooling water introduction passage connection portion 69*a* may protrude outward from the heat exchange tube housing 68, and may be inserted into one end of the cooling water introduction passage 93. The cooling water introduction passage connection portion 69*a* may have a tubular shape. The cooling water introduction passage connection portion 69*a* may protrude in a downward diagonal direction from the heat exchange tube housing 68. The cooling water introduction passage connection portion 69*a* is provided with a cooling water inlet 68*a*, which provides the communication between the inside of the cooling water introduction passage 93 and the inside of the heat exchange tube housing 68.

The heat exchange tube housing 68 includes a cooling water discharge passage connection portion 69*b*, which connects the inside of the heat exchange tube housing 68 to the cooling water discharge passage 96. The cooling water discharge passage connection portion 69*b* may protrude outward from the heat exchange tube housing 68, and may be inserted into one end of the cooling water discharge passage 96. The cooling water discharge passage connection portion 69*b* is formed on the top of the heat exchange tube housing 68. The cooling water discharge passage connection portion 69*b* may have a tubular shape. The cooling water discharge passage connection portion 69*b* is provided with a cooling water outlet 68*b*, which provides the communication between the inside of the cooling water discharge passage 96 and the inside of the heat exchange tube housing 68.

The cooling water discharge passage connection portion 69*b* is configured to maintain the cooling water at the level of water GH inside the heat exchange tube housing 68, at which all of the heat exchange tubes 61 are submerged in the cooling water, without the additional supply of cooling water. In this example, the cooling water discharge passage connection portion 69*b* first horizontally protrudes from the heat exchange tube housing 68 and is then bent upward.

More specifically, the cooling water discharge passage connection portion 69*b* may laterally protrude from the uppermost portion of the side surface of the heat exchange tube housing 68 and may then be bent upward. In some implementations, the cooling water discharge passage connection portion 69*b* may protrude upward from the heat exchange tube housing 68, and more particularly, may protrude upward from the uppermost portion of the upper surface of the heat exchange tube housing 68.

In this example, a portion of the lower surface of the heat exchange tube housing 68 includes a slope 68*c*, which serves to prevent interference with peripheral components. This serves to prevent the contact between the outer tub 5 and the condensation unit 60, which is located near the outer surface of the outer tub 5. Referring to FIG. 1, the condensation unit 60 is disposed on one side of the top of the outer tub 5. In order to position the condensation unit 60 close to the outer tub 5, a portion of the lower surface of the heat exchange tube housing 68 forms the slope 68*c*, which corresponds to the slope of the upper surface of the outer tub 5.

The upper fastening portion 64 is coupled to the upper coupling unit 66 in the direction in which the upper holes are formed. The lower fastening portion 63 is coupled to the lower coupling unit 65 in the direction in which the lower holes 611 are formed.

The upper coupling unit 66 includes a bracket 661 for coupling with the upper fastening portion 64. One surface of the bracket 661 comes into close contact with one surface of the upper fastening portion 64 and is coupled thereto via a fastening member, such as a bolt.

The upper coupling unit 66 includes an exhaust passage connection portion 662 for connection with the exhaust passage 50. The exhaust passage connection portion 662 may protrude outward from the upper coupling unit 66 and may be inserted into one end of the exhaust passage 50. The exhaust passage connection portion 662 may protrude downward from the upper coupling unit 66. In the center of the exhaust passage connection portion 662, a hole 662*a* is formed for communication between the inside of the exhaust passage 50 and the inside of the upper coupling unit 66.

The lower coupling unit 65 includes a bracket 651 for coupling with the lower fastening portion 63. One surface of the bracket 651 comes into close contact with one surface of the lower fastening portion 63 and is coupled thereto via a fastening member, such as a bolt.

The lower coupling unit 65 includes an exhaust passage connection portion 652 for connection with the exhaust passage 50. The exhaust passage connection portion 652 may protrude outward from the lower coupling unit 65 and may be inserted into one end of the exhaust passage 50. The exhaust passage connection portion 652 may protrude horizontally from the lower coupling unit 65. In the center of the exhaust passage connection portion 652, a hole 652*a* is formed for communication between the inside of the exhaust passage 50 and the inside of the lower coupling unit 65.

The lower coupling unit 65 includes a condensed water passage connection portion 653 for connection with the condensed water passage 70. The condensed water passage connection portion 653 protrudes downward from the lower coupling unit 65. The condensed water passage connection portion 653 may be inserted into one end of the condensed water passage 70. In the center of the condensed water passage connection portion 653, a condensed water outlet 653*a* is formed for communication between the inside of the condensed water passage 70 and the inside of the lower coupling unit 65. That is, the lower coupling unit 65 includes the condensed water outlet 653*a* formed in the lower end thereof for connection with the condensed water passage 70.

Referring to FIG. 10, the inner bottom surface of the lower coupling unit 65 forms a slope 654, which is inclined toward the condensed water outlet 653*a*. That is, the lower coupling unit 65 includes the slope 654, which is inclined so as to gather the condensed water to the condensed water outlet 653*a*. The slope 654 may have a funnel shape so that the condensed water gathers in one end of the condensed water passage 70.

The slope 654 may include slopes 654*a* and 654*b*, which can have any suitable inclination angles. In this example, in order to avoid interference with peripheral components, the slope 654 includes the slope 654*b*, which has an inclination angle greater than that of the slope 654*a*. This serves to prevent contact between the outer tub 5 and the condensation unit 60, which is located near the outer surface of the outer tub 5.

Referring to the arrow D in FIG. 11, in some implementations, the lower coupling unit 65 disperses the air introduced from the exhaust introduction passage 51 to the flow paths formed in the respective heat exchange tubes 61, and the upper coupling unit 66 gathers the air discharged from the flow paths formed in the respective heat exchange tubes 61 to the exhaust discharge passage 52.

Referring to the arrow D in FIG. 12, in some implementations, the upper coupling unit 66 disperses the air introduced from the exhaust introduction passage 51 to the flow paths formed in the respective heat exchange tubes 61, and the lower coupling unit 65 gathers the air discharged from the flow paths formed in the respective heat exchange tubes 61 to the exhaust discharge passage 52.

Referring to the arrows E in FIGS. 11 and 12, the condensed water generated in the heat exchange tubes 61 moves down along the inclined inner surfaces of the heat exchange tubes 61 due to the gravity, and is introduced into the lower coupling unit 65 through the lower holes 611. Referring to the arrow E in FIG. 10, the condensed water introduced into the lower coupling unit 65 moves along the slope 654 and is introduced into the condensed water passage 70 through the condensed water outlet 653*a*.

Referring to the arrows G in FIGS. 8, 11 and 12, the cooling water moving through the cooling water introduction passage 93 is introduced into the heat exchange tube housing 68 through the cooling water inlet 68*a*. The inside of the heat exchange tube housing 68 is filled with the cooling water until the cooling water reaches the level of water GH at which the cooling water outlet 68*b* is located. The cooling water moves through the predetermined gaps 62. In the state in which the cooling water is charged to the water level GH inside the heat exchange tube housing 68, the cooling water cannot flow over the cooling water discharge passage connection portion 69*b*. In this example, this is because the water will be charged only to the upwardly bent portion of the cooling water discharge passage connection portion 69*b*. Here, when additional cooling water is introduced into the heat exchange tube housing 68 through the cooling water inlet 68*a*, a portion of the cooling water flows over the cooling water discharge passage connection portion 69*b*, and thus a portion of the cooling water is introduced into the cooling water discharge passage 96 from the inside of the heat exchange tube housing 68.

Referring to FIG. 11, in some implementations, the heat exchange tubes 61 are inclined downward toward the upstream direction of the flow path of air. That is, the heat exchange tubes 61 have the inclination angle H with respect to the horizontal plane. The air inside the heat exchange tubes 61 moves in the upstream direction D along the slope. The air inside the heat exchange tubes 61 is reduced in temperature due to the heat exchange with the cooling water while moving upward, and the cooling water undergoes heat exchange with air having a higher temperature in the lower end of both longitudinal ends of the heat exchange tubes 61. Within the heat exchange tube housing 68, the cooling water having a lower temperature is present in the lower region due to convection. Accordingly, because the cooling water having a lower temperature undergoes heat exchange with the air having a higher temperature in the lower region, which may increase heat exchange efficiency.

Referring to FIG. 12, in some implementations, the heat exchange tubes 61 are inclined downward toward the downstream direction of the flow path of air. That is, the heat exchange tubes 61 have the inclination angle H with respect to the horizontal plane. The air inside the heat exchange tubes 61 moves in the downstream direction D along the slope. The condensed water generated in the heat exchange tubes 61 is reduced in the downward direction E along the slope. The condensed water passage 70 is coupled to, e.g., connected to, the downstream side of the heat exchange tubes 61. The condensed water may form a water membrane due to the surface tension thereof in the lower hole 611 in each heat exchange tube 61, and the water membrane may close the flow path of air defined in the heat exchange tube 61, which may deteriorate heat exchange efficiency. The formation of the water membrane may be reduced because the flowing air pushes the condensed water, which is present at the position at which the water membrane is formed, outward from the lower hole 611. In addition, because air having a higher temperature has a greater tendency to move upward, high temperature particles of the air passing through the heat exchange tube 61 move downward slowly and low temperature particles of the air move downward quickly. Thus, air having a sufficiently reduced temperature is first discharged from the heat exchange tube 61. This may increase dehumidification performance.

FIG. 13 illustrates an example condensation unit. FIG. 14 illustrates example flows of air and water in the example condensation unit of FIG. 13. FIG. 15 illustrates another example flows of air and water in the example condensation unit of FIG. 13.

The inclination angle H can be any suitable angle from 0 degree up to 90 degrees. As illustrated, the inclination angle H of the heat exchange tubes 61 can be a right angle, e.g., 90 degrees. However, in some implementations, the inclination angle H can be set differently. Unless described below, other details regarding the condensation unit can be the same as described with reference to FIGS. 5 to 12.

The upper coupling unit 66 includes the exhaust passage connection portion 662 for connection with the exhaust passage 50. The exhaust passage connection portion 662 may protrude outward from the upper coupling unit 66 and may be inserted into one end of the exhaust passage 50. The exhaust passage connection portion 662 may protrude horizontally from the upper coupling unit 66. In the center of the exhaust passage connection portion 662, the hole 662*a* is formed for communication between the inside of the exhaust passage 50 and the inside of the upper coupling unit 66.

The inner ceiling surface of the upper coupling unit 66 may form a slope 665. The slope 665 may be configured such that the spatial height inside the upper coupling unit 66 is gradually reduced from one side to the other side. The exhaust passage connection portion 662 is provided at the side having the highest height.

Referring to the arrow D in FIG. 14, in some implementations, the lower coupling unit 65 disperses the air introduced from the exhaust introduction passage 51 to the flow paths formed in the respective heat exchange tubes 61, and the upper coupling unit 66 gathers the air discharged from the flow paths formed in the respective heat exchange tubes 61 to the exhaust discharge passage 52.

Referring to the arrow D in FIG. 15, in some implementations, the upper coupling unit 66 disperses the air introduced from the exhaust introduction passage 51 to the flow paths formed in the respective heat exchange tubes 61, and the lower coupling unit 65 gathers the air discharged from the flow paths formed in the respective heat exchange tubes 61 to the exhaust discharge passage 52.

Referring to the arrows E in FIGS. 14 and 15, the condensed water generated in the heat exchange tubes 61 moves down along the inclined inner surfaces of the heat exchange tubes 61 due to the gravity, and is introduced into the lower coupling unit 65 through the lower holes 611. Referring to the arrow E in FIG. 10, the condensed water introduced into the lower coupling unit 65 moves along the slope 654 and is introduced into the condensed water passage 70 through the condensed water outlet 653*a*.

Referring to the arrows G in FIGS. 14 and 15, the cooling water moving through the cooling water introduction passage 93 is introduced into the heat exchange tube housing 68 through the cooling water inlet 68*a*. The inside of the heat exchange tube housing 68 is filled with the cooling water until the cooling water reaches the level of water GH at which the cooling water outlet 68*b* is located. The cooling water moves through the predetermined gaps 62. When additional cooling water is introduced into the heat exchange tube housing 68 through the cooling water inlet 68*a* in the state in which the cooling water is charged to the level of water GH inside the heat exchange tube housing 68, a portion of the cooling water is introduced into the cooling water discharge passage 96 from the inside of the heat exchange tube housing 68 through the cooling water outlet 68*b*.

Because the inclination angle H is a right angle, in the case where the heat exchange tubes 61 are inclined in the upstream direction of the flow paths of air (FIG. 13), the tendency for the cooling water having a low temperature to move to the lower region of the heat exchange tubes 61 and for the cooling water having a high temperature moves to the upper region of the heat exchange tubes 61 due to the convection of the cooling water becomes stronger. Thereby, heat exchange efficiency may be further increased.

Because the inclination angle H is a right angle, in the case where the heat exchange tubes 61 are inclined in the upstream direction of the flow paths of air (FIG. 13), the tendency that the particles of air having a high temperature, which pass through the heat exchange tubes 61, move downward slowly and the particles of air having a low temperature move downward quickly becomes more into focus. Thereby, dehumidification performance may further be increased.

A control method of the laundry treatment apparatus includes an air moving step of moving air in the flow path of air. In this example, the flow path of air is the exhaust passage 50.

The control method includes an intermittently supplying cooling water step. In the intermittently supplying cooling water step, cooling water is provided to the heat exchange tube housing. The intermittently supplying cooling water step tube housing includes repeating the process of blocking the cooling water so that the cooling water gathers inside the heat exchange tube housing 68 and the process of supplying the cooling water into the heat exchange tube housing 68 during the air moving step.

The process of blocking the cooling water may be performed by closing the cooling water valve 91. The process of supplying the cooling water may be performed by opening the cooling water valve 91, and the cooling water may be supplied by the pressure of water from the water supply source, or the pressure of water formed by the cooling water pump.

Thereby, the cooling water may be discharged from the heat exchange tube housing 68 after sufficiently undergoing heat exchange with the air inside the heat exchange tube housing 68, which may increase heat exchange efficiency based on usage of the same amount of water.

In some implementations, during the intermittently supplying cooling water step, the process of blocking the cooling water and the process of supplying the cooling water may be repeated at a preset predetermined time interval. For example, the process of supplying the cooling water may be performed for a predetermined first time, and the process of blocking the cooling water may be performed for a predetermined second time. The predetermined first time and the predetermined second time may be preset depending on, for example the supply amount of cooling water per hour and the required thermal capacity of cooling water.

In some implementations, during the intermittently supplying cooling water step, the process of blocking the cooling water and the process of supplying the cooling water may be controlled based on the temperature of cooling water inside the heat exchange tube housing 68. To this end, a temperature sensor may be provided to sense the temperature of cooling water at a predetermined position inside the heat exchange tube housing 68. Based on the sensed temperature of the cooling water inside the heat exchange tube housing 68, in the intermittently supplying cooling water step, the time during which the process of blocking the cooling water is performed may be adjusted. In addition, based on the sensed temperature of the cooling water inside the heat exchange tube housing 68, in the intermittently supplying cooling water step, the time during which the process of supplying the cooling water is performed may be adjusted.

In some implementations, the control method includes a temperature sensing step of sensing the temperature of the cooling water inside the heat exchange tube housing 68. In the intermittently supplying cooling water step, a predetermined first temperature and a predetermined second temperature may be preset such that the process of blocking the cooling water begins when the temperature of the cooling water inside the heat exchange tube housing 68 is equal to or less than the predetermined first temperature, and such that the process of supplying the cooling water begins when the temperature of the cooling water inside the heat exchange tube housing 68 is equal to or greater than the predetermined second temperature. The predetermined first temperature is less than the predetermined second temperature.

Thereby, when the temperature of the cooling water is lowered to some extent in the process of supplying the cooling water, a considerable reduction in heat exchange efficiency may be prevented even if the cooling water is blocked. Then, when the temperature of the cooling water is raised to some extent, additional cooling water is supplied to maintain consistent heat exchange efficiency. In addition, the intermittently supplying cooling water step may reduce the usage of cooling water.

The control method includes an initial cooling water supply step of filling the cooling water so that all of the heat exchange tubes 61 are submerged in the cooling water inside the heat exchange tube housing 68, before the intermittently supplying cooling water step. In some implementations, the heat exchange tubes 61 can be fully submerged in the cooling water. In some other implementations, a particular portion, e.g., at least 50%, of each heat exchange tube of the heat exchange tubes 61, e.g., can be submerged in the cooling water.

Thereby, the inside of the heat exchange tube housing 68 may be full of the cooling water even when the cooling water is not continuously supplied, which may increase heat exchange efficiency.

The invention claimed is:

1. A laundry treatment apparatus comprising:

a cabinet;

an outer tub that is disposed inside the cabinet;

a plurality of heat exchange tubes through which air discharged from the outer tub moves, the plurality of heat exchange tubes (i) being arranged to have a gap between adjacent heat exchange tubes and (ii) being parallel to each other;

a heat exchange tube housing that is configured to accommodate the plurality of heat exchange tubes and that defines an interior area configured to store cooling water;

a cooling water introduction passage that is coupled to a lower portion of the heat exchange tube housing and through which cooling water is provided to the heat exchange tube housing; and a cooling water discharge passage that is coupled to an upper portion of the heat exchange tube housing and through which cooling water stored in the heat exchange tube housing is discharged.

2. The laundry treatment apparatus of claim 1, wherein the plurality of heat exchange tubes are inclined along an air flow path of air discharged from the outer tub.

3. The laundry treatment apparatus of claim 1, further comprising:

a lower coupling unit that is coupled to a lower end of each heat exchange tube of the plurality of heat exchange tubes; and an upper coupling unit that is coupled to an upper end of each heat exchange tube of the plurality of heat exchange tubes.

4. The laundry treatment apparatus of claim 3, further comprising:

a condensed water passage that is coupled to the lower coupling unit and that is configured to guide condensed water generated in the plurality of heat exchange tubes.

5. The laundry treatment apparatus of claim 1, further comprising:

an exhaust passage through which air is exhausted from the outer tub, wherein the plurality of heat exchange tubes are disposed in the exhaust passage.

6. The laundry treatment apparatus of claim 1, further comprising:

a cooling water valve that is coupled to the cooling water introduction passage and that is configured to control flow of cooling water into the heat exchange tube housing.

7. The laundry treatment apparatus of claim 3, further comprising:

a lower fastening portion that is coupled to the lower ends of the plurality of heat exchange tubes and that is configured to maintain the gap between the adjacent heat exchange tubes of the plurality of heat exchange tubes; and an upper fastening portion that is coupled to the upper ends of the plurality of heat exchange tubes and that is configured to maintain the gap between the adjacent heat exchange tubes of the plurality of heat exchange tubes.

8. The laundry treatment apparatus of claim 1, wherein the heat exchange tube housing includes:

a cooling water discharge passage coupling portion that couples the heat exchange tube housing to the cooling water discharge passage, and wherein the cooling water discharge passage coupling portion protrudes horizontally relative to the heat exchange tube housing and is bent upward.

9. The laundry treatment apparatus of claim 1, wherein the heat exchange tube housing includes:

a cooling water discharge passage coupling portion that couples the heat exchange tube housing to the cooling water discharge passage, and wherein the cooling water discharge passage coupling portion protrudes vertically relative to the heat exchange tube housing.

10. The laundry treatment apparatus of claim 4, wherein the cooling water discharge passage couples the heat exchange tube housing to the lower coupling unit and that is configured to guide cooling water from the heat exchange tube housing to the lower coupling unit.

11. The laundry treatment apparatus of claim 4, wherein the lower coupling unit includes:

a condensed water outlet that is located at a lower portion of the lower coupling unit and that is coupled to the condensed water passage, and wherein the lower coupling unit is inclined relative to the condensed water outlet.

12. The laundry treatment apparatus of claim 2, wherein the plurality of heat exchange tubes are inclined downwardly along the air flow path of air discharged from the outer tub.

13. The laundry treatment apparatus of claim 12, wherein the plurality of heat exchange tubes are vertically inclined.

14. The laundry treatment apparatus of claim 2, wherein the plurality of heat exchange tubes are inclined upwardly along the air flow path of air discharged from the outer tub.

15. The laundry treatment apparatus of claim 14, wherein the plurality of heat exchange tubes are vertically inclined.

16. A control method of a laundry treatment apparatus, the laundry treatment apparatus comprising a cabinet, an outer tub that is disposed inside the cabinet, a plurality of heat exchange tubes through which air discharged from the outer tub moves, the plurality of heat exchange tubes being arranged to have a gap between adjacent heat exchange tubes, a heat exchange tube housing that is configured to accommodate the plurality of heat exchange tubes and that defines an interior area configured to store cooling water, a cooling water introduction passage that is coupled to a lower portion of the heat exchange tube housing and through which cooling water is provided to the heat exchange tube housing, and a cooling water discharge passage that is coupled to an upper portion of the heat exchange tube housing and through which cooling water stored in the heat exchange tube housing is discharged, the control method comprising:

providing the air through the plurality of heat exchange tubes; and intermittently supplying cooling water to the heat exchange tube housing during the providing the air, wherein the intermittently supplying cooling water repeats a process of blocking the cooling water so that the cooling water gathers inside the heat exchange tube housing and a process of supplying the cooling water into the heat exchange tube housing.

17. The control method of claim 16, further comprising:

before the intermittently supplying cooling water, filling the heat exchange tube housing with cooling water until at least a lower portion of each heat exchange tube of the plurality of heat exchange tubes is submerged in cooling water.

18. The control method of claim 16, further comprising:

sensing a temperature of cooling water in the heat exchange tube housing, and based on the temperature of cooling water in the heat exchange tube housing, controlling a first time duration of the process of blocking the cooling water and a second time duration of the process of supplying the cooling water into the heat exchange tube housing.

19. The control method of claim 16, further comprising:

sensing a temperature of cooling water in the heat exchange tube housing, and based on the temperature of cooling water in the heat exchange tube housing, controlling timing to begin blocking the cooling water discharge passage.

20. The control method of claim 16, further comprising:

sensing a temperature of cooling water in the heat exchange tube housing, and based on the temperature of cooling water in the heat exchange tube housing, controlling timing to begin supplying cooling water to the heat exchange tube housing.

* * * * *